US006591606B2

(12) United States Patent
Rosskamp et al.

(10) Patent No.: US 6,591,606 B2
(45) Date of Patent: Jul. 15, 2003

(54) INTERNAL COMBUSTION ENGINE AS A DRIVE ENGINE IN A PORTABLE HANDHELD WORK APPARATUS

(75) Inventors: Heiko Rosskamp, Adelberg (DE); Axel Rauch, Oberndorf (DE); Holger Lochmann, Waiblingen (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/971,761

(22) Filed: Oct. 9, 2001

(65) Prior Publication Data

US 2002/0040578 A1 Apr. 11, 2002

(30) Foreign Application Priority Data

Oct. 11, 2000 (DE) ..... 100 50 208

(51) Int. Cl.[7] ..... F01N 3/10
(52) U.S. Cl. ..... 60/302; 60/286; 123/65 PE
(58) Field of Search ..... 60/285, 286, 301, 60/302; 123/65 A, 65 P, 65 PE, 73 PP, 73 A, 74 A, 74 AA; 423/213.2, 213.5

(56) References Cited

U.S. PATENT DOCUMENTS

| | | | | |
|---|---|---|---|---|
| 4,209,493 A | | 6/1980 | Olson | |
| 4,469,054 A | * | 9/1984 | Onishi et al. | 123/73 A |
| 4,890,690 A | | 1/1990 | Fischer et al. | |
| 4,924,820 A | * | 5/1990 | Lear et al. | 60/302 |
| 4,938,178 A | * | 7/1990 | Schlunke et al. | 123/65 PE |
| 4,969,329 A | * | 11/1990 | Bolton et al. | 60/301 |
| 5,626,826 A | * | 5/1997 | Chopin et al. | 423/213.2 |
| 5,732,555 A | | 3/1998 | Gracyalny et al. | |
| 5,857,327 A | * | 1/1999 | Sato et al. | 60/302 |
| 5,870,981 A | * | 2/1999 | Knaus et al. | 123/73 PP |
| 5,902,971 A | | 5/1999 | Sato et al. | |
| 6,039,013 A | * | 3/2000 | Motose | 123/65 PE |
| 6,164,066 A | * | 12/2000 | Sakaguchi et al. | 60/302 |
| 6,174,504 B1 | * | 1/2001 | Silver et al. | 423/213.5 |

FOREIGN PATENT DOCUMENTS

| | | |
|---|---|---|
| DE | 199 00 445 | 7/2000 |
| EP | 0 816 648 | 1/1998 |
| JP | 2000018028 | 1/2000 |
| WO | WO 00/11334 | 3/2000 |

* cited by examiner

*Primary Examiner*—Thomas Denion
*Assistant Examiner*—Tu M. Nguyen
(74) *Attorney, Agent, or Firm*—Walter Ottesen

(57) ABSTRACT

The invention relates to an internal combustion engine and especially to a drive motor in a portable handheld work apparatus such as a motor-driven chain saw, cutoff machine or the like. The engine is formed from a cylinder (7) with a combustion chamber (34) which is delimited by the reciprocating piston (35). The piston (35) drives a crankshaft (38) which is rotatably journalled in a crankshaft housing (37) via a connecting rod (36). In the combustion chamber (34) an outlet (29) is provided through which the oxygen-rich exhaust gases (16) and oxygen-poor exhaust gases (18) flow out. Transfer channels (40) are configured in the cylinder (7) for supplying an air/fuel mixture prepared by a mixture preparation device (39) and gas-feeding channels (41) are configured for supplying fuel-poor, oxygen-rich gases in the combustion chamber (34). An exhaust-gas muffler (2) is assigned to the outlet (29) according to the invention to obtain an exhaust-gas quality which remains the same. A structure (15) is provided in the exhaust-gas muffler (2) for the temporary storage of the oxygen-rich exhaust gases (16).

27 Claims, 3 Drawing Sheets

INTERNAL COMBUSTION ENGINE AS A DRIVE ENGINE IN A PORTABLE HANDHELD WORK APPARATUS

BACKGROUND OF THE INVENTION

German published patent application 199 00 445 discloses an internal combustion engine for a portable handheld work apparatus which has gas-conducting channels for fuel-rich gas and fuel-poor gas in its cylinder. The fuel-poor to fuel-free gas is supplied via outlet-near channels; whereas, the fuel component, which is necessary for the operation of the engine, is supplied via the outlet-remote channels. In this way, the fuel-free gas can screen off the outlet in the manner of an air curtain so that the fuel-rich gas does not flow out through the outlet. International published patent application WO 00/11334 discloses an internal combustion engine which has a fuel supply supported by compressed air.

The internal combustion engines, which are utilized for portable handheld work apparatus, are often configured as stratified charge engines or scavenging advance engines. The present invention is directed especially to engines of this kind.

U.S. Pat. No. 4,890,690 discloses an exhaust-gas muffler for a two-stroke engine whose housing comprises two parts which can be disassembled. A partition wall is fixedly mounted in the interior of the muffler housing and holds a catalytic converter in a through opening. The catalytic converter constitutes the flow connection for the exhaust gases between the two compartments at both sides of the partition wall.

If, in alternating sequences, exhaust gases having high oxygen concentration and oxygen-poor, hydrocarbon-rich exhaust gases from the engine reach an exhaust-gas muffler having a catalytic converter, then the oxygen-rich exhaust gases can lead to a poisoning of the active centers of the catalytic converter whereby the function of the catalytic converter is affected.

SUMMARY OF THE INVENTION

It is an object of the invention to improve the quality of the exhaust gas in an internal combustion engine of the kind described above.

The internal combustion engine of the invention includes an engine in a portable handheld work apparatus including a motor-driven chain saw, cutoff machine and blower apparatus. The internal combustion engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; an outlet for conducting oxygen-rich and oxygen-poor exhaust gases away from the combustion chamber; a mixture-preparation unit for supplying an air/fuel mixture; a first set of gas-supplying channels for supplying an air/fuel mixture to the combustion chamber prepared by the mixture preparation device; a second set of gas-supplying channels for supplying oxygen-rich gas to the combustion chamber; an exhaust-gas muffler having a housing and an inlet on the housing fluidly connected to the outlet to permit the oxygen-rich and the oxygen-poor exhaust gases to flow into the exhaust-gas muffler; the housing having an interior and a partition wall for partitioning the interior into a first space communicating with the outlet and a second space; a catalytic converter mounted in the housing; and, means for temporarily storing the oxygen-rich exhaust gas to thereby even out the oxygen component in the total exhaust-gas flow charging the catalytic converter.

In an internal combustion engine of the above kind, the fuel-poor to fuel-free gas is preferably supplied via outlet-near channels; whereas, the fuel component, which is necessary for the operation of the engine, is supplied via the outlet-remote channels. In this way, the fuel-free gas can screen the outlet in the manner of an air curtain so that the fuel-rich gas does not flow away via the outlet. The gas components, which flow away via the outlet, comprise substantially the fuel-poor or fuel-free but oxygen-rich gases from an early phase of the scavenging and the hydrocarbon-containing, oxygen-poor gases from a late phase of the scavenging and from the combustion. The exhaust gases get from the outlet of the engine into an inlet of an exhaust-gas muffler.

The inventors herein have determined that, in the oxygen-poor volume component of the exhaust gas, sufficient oxygen for oxidizing the hydrocarbons in the exhaust gas is no longer available which would be necessary for a high degree of conversion of the hydrocarbons. By intermediately storing oxygen from the oxygen-rich volume component of the exhaust gas, this component is utilized for oxidizing the hydrocarbons in the oxygen-poor volume component of the exhaust gas and, in this way, a higher rate of conversion is obtained.

The housing of the exhaust-gas muffler is preferably formed of two or more housing parts. A partition wall extends in the interior of the exhaust-gas muffler and partitions the housing of the muffler into at least two compartments or spaces. The partition wall is held substantially gastight with its edge at the housing of the muffler. In a preferred embodiment, a catalytic converter is held in a through opening of the partition wall and is, for example, configured as a cartridge. The housing of the catalytic converter is fixed substantially gastight in the through opening of the partition wall. The catalytic converter functions as a flow connection for exhaust gases between the inlet and the outlet of the exhaust-gas muffler.

As an alternative to the configuration of the catalytic converter as a cartridge, inner wall portions of the exhaust-gas muffler, for example, the partition wall, can be coated with a catalytically effective material.

In accordance with a first embodiment of the invention, a buffer space for oxygen-poor and oxygen-rich exhaust gas (such as for advance air and hydrocarbon-rich exhaust gas) is formed in the first compartment of the muffler housing between the inlet and the catalytic converter. A wall having a plurality of breakthroughs preferably extends through the buffer space. The wall extends in the interior of the first compartment of the muffler housing over the entire cross section thereof. In this way, a structure is provided for temporarily storing oxygen-rich exhaust gases with a storage space lying next to the inlet and a mixture space is formed for the oxygen-rich and oxygen-poor exhaust gases between the inlet of the exhaust-gas muffler and the inlet of the catalytic converter. The oxygen-rich and oxygen-poor exhaust gases, but also hydrocarbon-rich exhaust gas enter alternately one after the other into the buffer space. These gases are mixed with each other in the buffer space before they flow into the catalytic converter. The catalytic converter is protected from being charged with oxygen-rich exhaust gas. A poisoning of the active centers of the catalytic converter is thereby avoided and a permanent operation of the catalytic converter is ensured. It can be practical to provide the wall, which extends through the buffer space, with strip-shaped mutually parallel aligned breakthroughs. Preferably, an edge of the breakthroughs is bent over so that a deflection of the exhaust gases, which flow through the breakthroughs, is effected. Mixing of the exhaust gas is thereby supported.

According to a second embodiment of the invention, a means for temporarily storing oxygen-rich exhaust gases, such as the advanced air of the engine, can be provided in the region of the catalytic converter in lieu of the storage or mixture space for oxygen-rich and oxygen-poor exhaust gases arranged in the housing of the exhaust-gas muffler. For this purpose, the effective surface of the catalytic converter is provided with cerium oxides, zirconium oxides or aluminum oxides or a mixture of these oxides. These substances have an increased oxygen storage capacity whereby an oxygen poisoning of the active centers of the catalytic converter is avoided. It can furthermore be practical to mix to the above-mentioned oxides migration-retarding substances such as praseodymium or other lanthanides or actinides for stabilizing the precious metals (active centers).

It is practical to multiply deflect the exhaust-gas flow in the muffler in order to effect a limiting of the flow velocity of the exhaust gases in the interior of the exhaust-gas muffler and during the passage through the catalytic converter. Accordingly, it is preferable to mount a deflector at the inlet of the muffler on its inner side. This deflector deflects the exhaust gases flowing into the muffler. In addition, it is practical to deflect the exhaust gases between the outlet of the catalytic converter and the outlet of the muffler via a spatial offset of the outlets of the catalytic converter and the exhaust-gas muffler.

Preferably, the volume of the muffler between the inlet and the outlet is approximately 2.5 to 18 times (especially 6 to 11 times) as large as the stroke volume of the engine. This constructive measure effects an excellent mixture of the exhaust gases in the interior of the exhaust-gas muffler and a uniform passage of the exhaust gases through the exhaust-gas muffler. The volume of the catalytic converter including the oxygen store can, for example, amount to 0.3 to 10 times the stroke volume of the engine.

It can be practical to at least surround the second space of the muffler with an enclosing housing and preferably further enclose the entire exhaust-gas muffler with this housing. Cooling air is conducted in the enclosing housing which reinforces a transport of heat away from the interior of the exhaust-gas muffler. It can be practical to deflect only a component flow of the exhaust gas through the catalytic converter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
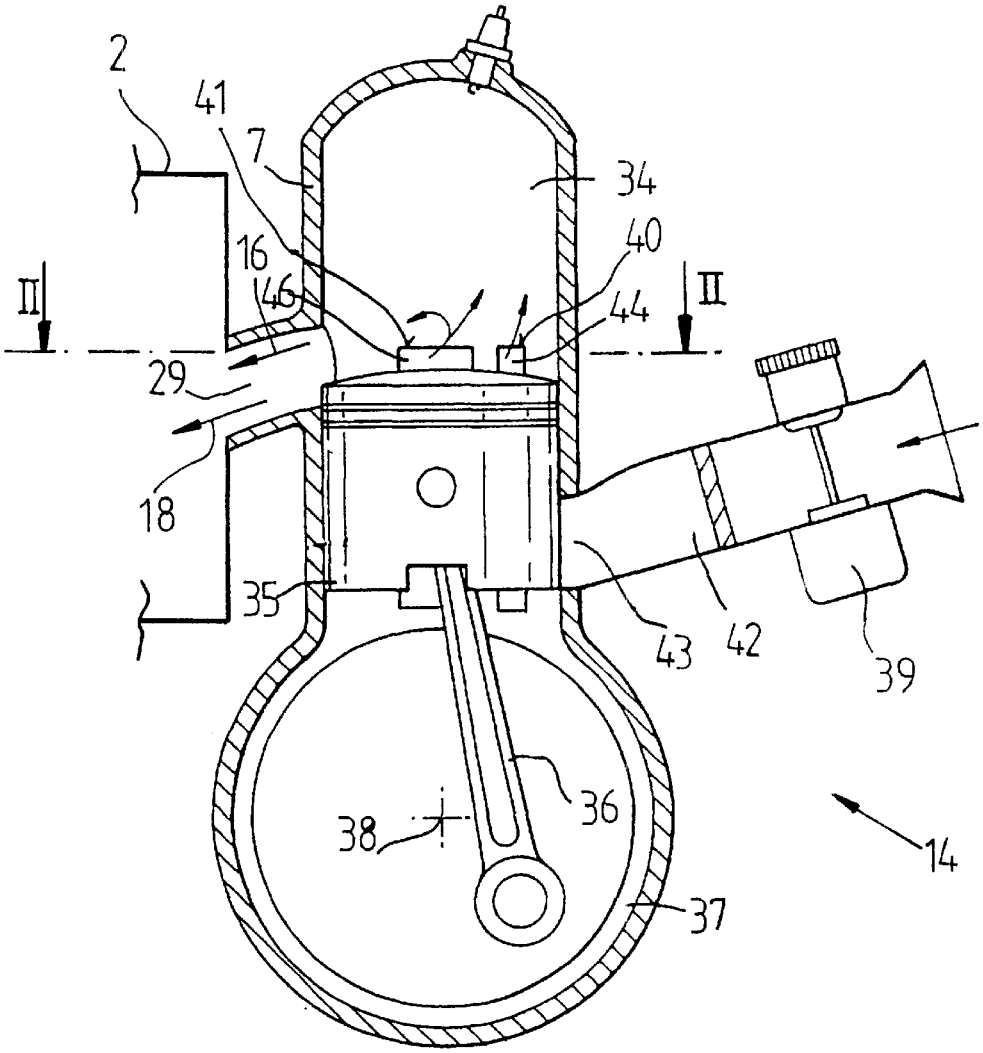
FIG. 1 is a schematic section view taken through a two-stroke engine.
Figure 2:
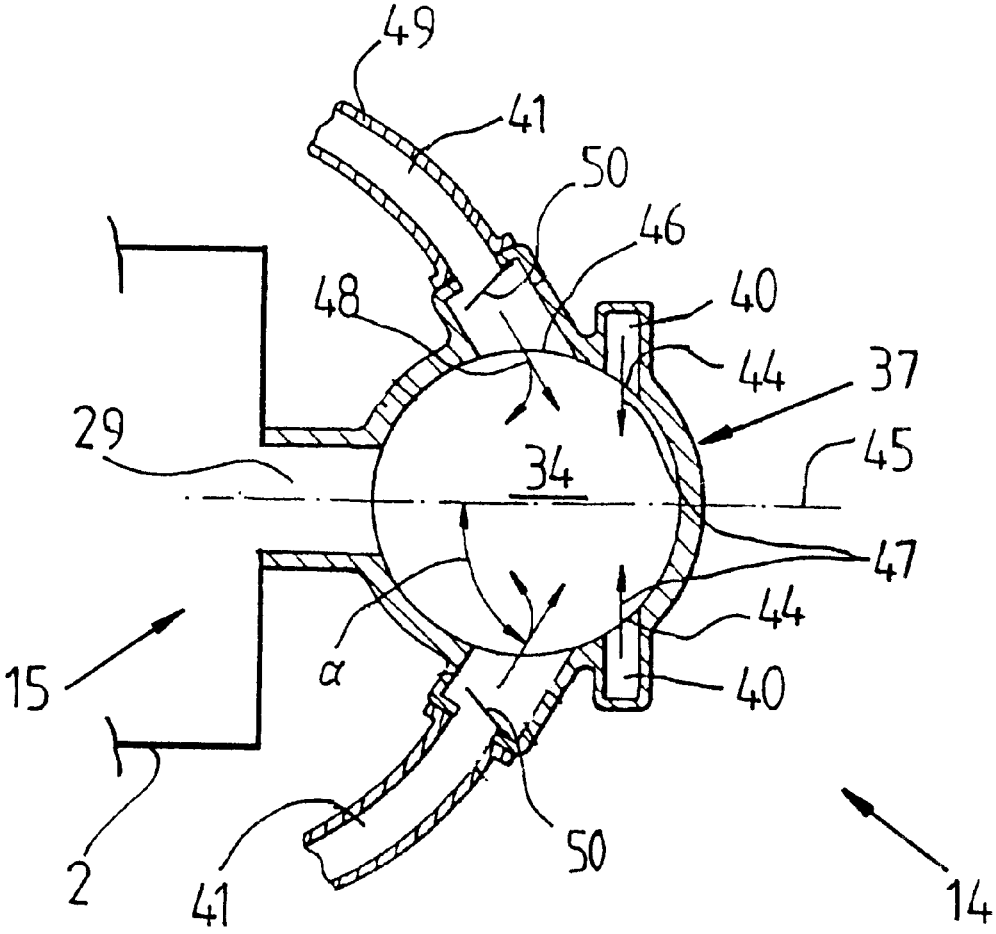
FIG. 2 is a schematic section view taken along line II—II of FIG. 1.

The two-stroke engine 14 shown in FIGS. 1 and 2 can be used especially as a drive motor in a portable handheld work apparatus such as a motor-driven chain saw or the like. The two-stroke engine 14 comprises a cylinder 7 wherein a combustion chamber 34 is delimited toward the crankcase 37 by a reciprocating piston 35. The piston 35 is connected via a connecting rod 36 to a crankshaft 38 rotatably journalled in the crankcase 37. The piston 35 drives the crankshaft 38.

An outlet 29 is assigned to the combustion chamber 34 and exhaust gases flow out through this outlet. The air/fuel mixture, which is necessary to operate the two-stroke engine 14, is prepared in a mixture preparation device 39 such as a membrane carburetor and is supplied to the crankcase 37 via an inlet channel 42 and an inlet 43.

As shown in FIG. 2, the crankcase 37 is connected to the combustion chamber 34 via at least two transfer channels 40. The inlet windows 44 of the transfer channels 40 lie, referred to a symmetry axis 45, diametrically opposite each other. In the peripheral direction of the cylinder 7, at least respective further outlet-near respective channels 41 lie between the outlet-remote arranged transfer channels 40 and the outlet 29. The inlet windows 46 of the respective channels 41 lie diametrically opposite each other referred to the axis 45 of symmetry. As shown in FIG. 2, the transfer channels 40 are so arranged that an air/fuel mixture flows in in the direction of arrow 47. Viewed in plan, the air/fuel mixture flows into the combustion chamber 34 at an angle of <90° viewed in plan. Preferably, the entry inflow is approximately at right angles to the axis of symmetry 45. The gas or air, which enters via the channels 41 in the arrow direction 48, has a flow direction which forms an angle $\alpha$ open to the outlet 29 with the axis of symmetry 45. The combustion chamber 34 therefore has four supplying gas channels (40, 41) and an outlet 29 on which a muffler 2 is mounted.

A lean medium, that is, a fuel-poor mixture or only air, is supplied to the combustion chamber 34 via the outlet-near channels 41; whereas, a rich mixture enters into the combustion chamber 34 via the outlet-remote channels 40. The channels 41 are open toward the crankcase 37 and an air intake stub 49 opens into the combustion chamber 34 between the crankcase 37 and the inlet window 46. As shown in FIG. 2, the air intake stub 49 advantageously opens via a membrane valve 50, which is configured as a check valve, in the outlet-near channel 41. The volume of the outlet-near channels 41 is greater, especially a multiple greater than the volume of the outlet-remote channels 40.

The piston 35 controls, in a manner known per se, the inlet 43, the outlet 29 and the inlet windows 44 and 46 of the channels 40 and 41, respectively. For an upward movement of the piston 35, all of the channels which open into the combustion chamber 34 are closed; whereas, the inlet 43 of the mixture preparation device 39 is opened to the crankcase 37. Because of the upward travel of the piston, an underpressure develops in the crankcase 37 which is compensated by the induction of an air/fuel mixture via the inlet 43. If the channels 41 are opened to the crankcase 37, the underpressure, which develops in the crankcase 37, simultaneously effects an induction of air via the air induction stub 49 and the membrane valves 50 which are open because of the pressure conditions. The volumetrically large outlet-near channels 41 fill with air and, with increasing pressure compensation in the crankcase, the membrane valves 50 close and a further inflow of air is prevented. Essentially clean air remains in the volumes of the outlet-near channels 41.

After the ignition in the combustion chamber 34, which takes place in the region of top dead center, the piston 35 travels downwardly in a direction toward the crankcase 37 because of the expansion pressure. The outlet 29 is first opened because of the position of the inlet windows 44 and 46 and a portion of the exhaust gases, which are under pressure, flow out. In the further downward movement of the piston 35, the outlet windows 44 and 46 of the channels 40 and 41, respectively, open simultaneously in this embodiment. Only a rich air/fuel mixture flows in via the transfer channels 40; whereas, because of the overpressure which builds up in the crankcase 37, the air volume, which is located in the outlet-near channels 41, is pushed out via the inlet window 46 into the combustion chamber 34. The entering air places itself as a protective curtain in front of the outlet 29 so that the richer mixture cannot flow out via the outlet 29. In this way, the scavenging losses are significantly reduced.

Figure 3:
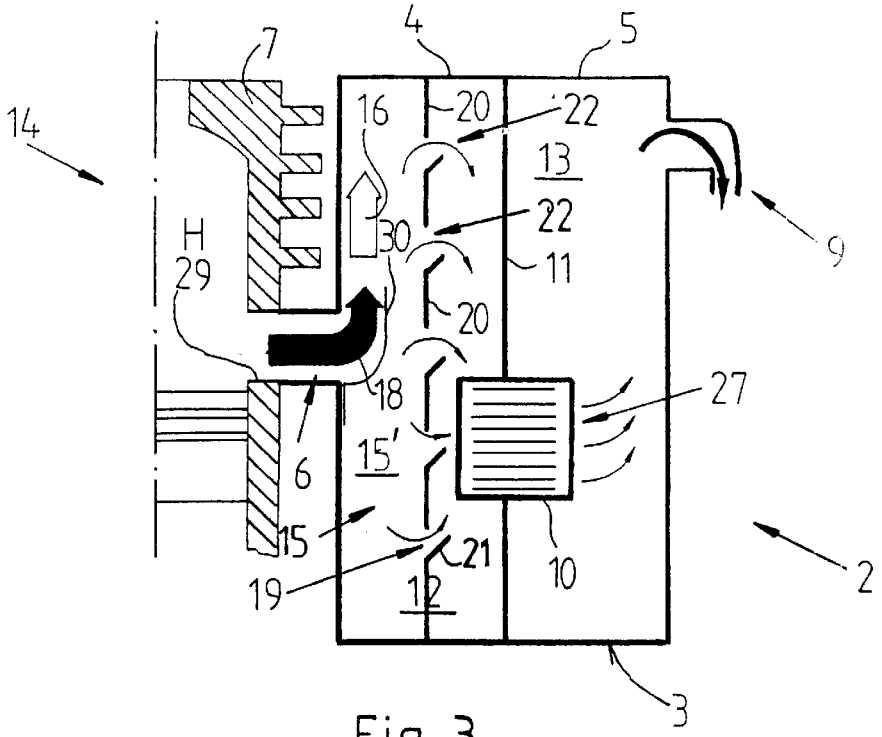
FIG. 3 is a schematic section view through an exhaust-gas muffler mounted on the two-stroke engine; and, FIG. 4 is a schematic section view taken through another embodiment of the exhaust-gas muffler.

The muffler 2 shown in FIG. 3 is fixed at the outlet 29 of the cylinder 7 of the two-stroke engine 14. The housing 3 of the muffler 2 is formed from two shell-shaped parts (4, 5) which are connected gastight to each other. The inlet 6 of the housing 3 is coincident with the outlet 29 of the two-stroke engine 14. A partition wall 11 is arranged in the interior of the housing 3 and partitions the housing 3 into a space 12 open toward the inlet 6 and a space 13 open to the outlet 9 of the housing 3. A catalytic converter 10 is held in the partition wall 11 and functions as a fluid connection of the exhaust gases between the spaces 12 and 13. In a two-stroke engine, the exhaust gases comprise oxygen-poor and hydrocarbon-rich exhaust gases 18 and oxygen-rich exhaust gases 16 such as the advance air (see also FIG. 1).

To avoid an alternating entering of oxygen-poor and oxygen-rich exhaust gases into the catalytic converter 10, another embodiment of the invention provides arranging a buffer space 15' for the oxygen-rich and oxygen-poor exhaust gases in flow direction of the exhaust gases ahead of the catalytic converter 10. For this purpose, a wall 20 is arranged in the first space 12 of the muffler housing 3. In the wall 20, a breakthrough 19 is introduced, preferably however several strip-shaped mutually parallelly arranged breakthroughs 22 are provided. The breakthroughs 22 each have a bent-over edge 21 to flow deflect the exhaust gases. The exhaust gases (16, 18) enter into the muffler 2 in alternating sequence one after the other via the inlet 6. The exhaust gases (16, 18) are deflected by a deflector 30 in the interior of the exhaust-gas muffler and reach the buffer space 15' and, via the breakthroughs 22 in the wall 20, the catalytic converter 10. Oxygen-rich and oxygen-poor exhaust gases are mixed with this configuration in advance of entering into the catalytic converter 10.

In addition to the buffer space or in lieu thereof, it can be practical to configure the catalytic converter 10 itself as means 15 for temporarily storing oxygen-rich exhaust gases 16. For this purpose, the catalytic converter is provided with oxygen-storing substances such as cerium oxide 23, zirconium oxide 24 and aluminum oxide 25 or with a mixture of the above oxides, preferably an oxide mixture according to the formula $Zr_xCe_{1-x}O_2$ (see FIG. 4). The active centers of the catalytic converter are thereby protected from the oxidizing action of the oxygen-rich gases. In addition, it can be practical to mix in migration-retarding substances 26 into the catalytic converter material such as praseodymium or other lanthanides or actinides to protect the precious metals and titanium oxide to protect the oxygen store.

To slow the flow of the exhaust gas in the exhaust-gas muffler 2, it is practical to separate the outlet 27 of the catalytic converter 10 spatially from the outlet 9 of the muffler 2 so that the exhaust gases, which flow out of the catalytic converter 10, are deflected before they reach the ambient. It can, under certain circumstances, be practical not to conduct the entire exhaust gas flow through the catalytic converter 10 but to instead provide a bypass 17 in the partition wall 11 through which one component volume of the exhaust gas passes from the first space 12 into the second space 13. If required, the bypass can be configured so as to be controllable.

Figure 4:
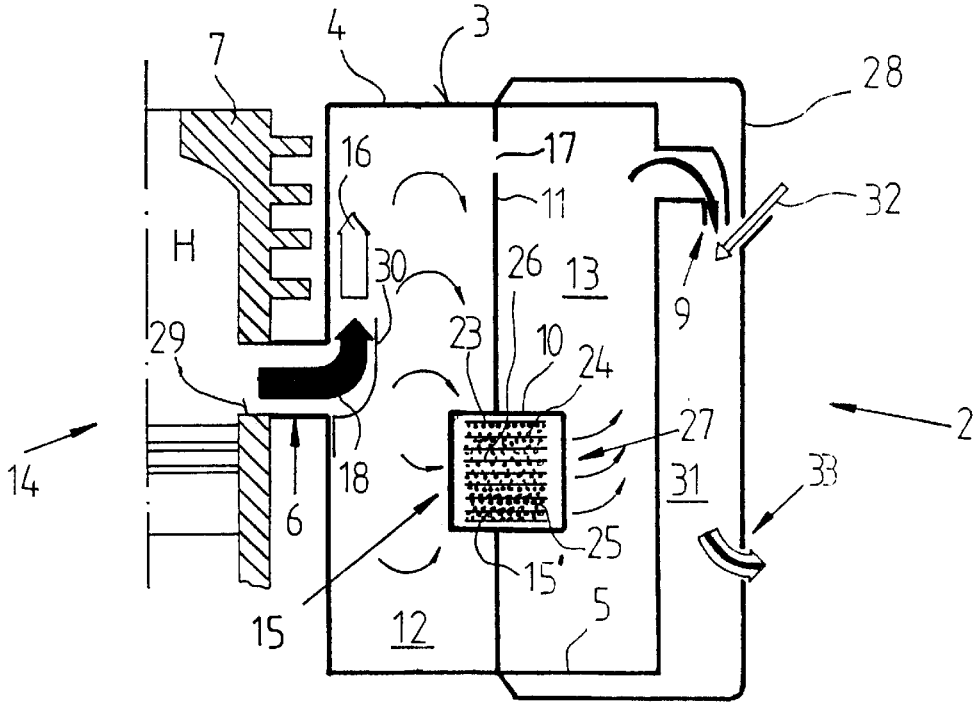

The volume of the muffler 2 is advantageously approximately 2.5 to 18 times (preferably 6 to 11 times) greater than the stroke volume H of the two-stroke engine 14. In this way, a sufficient storage and mixing action of the catalytic converter is effected on the exhaust gas. As FIG. 4 shows, at least the second space 13 of the housing 3 of the muffler 2 can be surrounded by an enclosure 28 at a spacing for cooling the muffler. Cooling air 32 is supplied in the region of the outlet 9 of the muffler in the flow space 31 between the enclosure 28 and the housing 3. The exhaust gases and the cooling air are mixed with each other in the flow space 31 and are carried into the ambient through an outlet 33 of the enclosure 28.

It is understood that the foregoing description is that of the preferred embodiments of the invention and that various changes and modifications may be made thereto without departing from the spirit and scope of the invention as defined in the appended claims.

What is claimed is:

1. An internal combustion engine including an engine in a portable handheld work apparatus, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an outlet for conducting oxygen-rich and oxygen-poor exhaust gases away from said combustion chamber;

a mixture-preparation unit for supplying an air/fuel mixture;

a first set of gas-supplying channels for supplying an air/fuel mixture to said combustion chamber prepared by said mixture preparation device;

a second set of gas-supplying channels for supplying oxygen-rich gas to said combustion chamber;

said first set of gas-supplying channels and said second set of gas-supplying channels opening into said combustion chamber so as to cause said oxygen-rich gases and said oxygen-poor exhaust gases to alternately flow through said outlet;

an exhaust-gas muffler having a housing and an inlet on said housing fluidly connected to said outlet to permit said oxygen-rich and said oxygen-poor gases to alternately flow into said exhaust-gas muffler;

said housing having an interior and a discharge opening communicating with said interior;

a catalytic converter mounted in said housing between said inlet and said discharge opening; and, buffering means disposed in said housing for temporarily storing said oxygen-rich exhaust gas to thereby even out the oxygen component in the total exhaust-gas flow charging said catalytic converter.

2. The internal combustion engine of claim 1, wherein said buffering means for temporarily storing said oxygen-rich exhaust gas is configured to mix said oxygen-rich and oxygen-poor exhaust gases.

3. The internal combustion engine of claim 1, said buffering means for temporarily storing said oxygen-rich exhaust gas comprising a buffer space disposed between said catalytic converter and said inlet.

4. The internal combustion engine of claim 1, said catalytic converter having an outlet and said exhaust gas muffler comprising deflecting means for rerouting said exhaust gases between said outlet of said catalytic converter and said discharge opening.

5. The internal combustion engine of claim 1, said muffler having a volume 2.5 to 18 times the stroke volume of said engine.

6. The internal combustion engine of claim 1, said catalytic converter having an oxygen store and a volume including said oxygen store which is 0.3 to 10 times the stroke volume (H) of said engine.

7. The internal combustion engine of claim 1, wherein said internal combustion engine is a two-stroke engine.

8. The internal combustion engine of claim 1, wherein said portable handheld work apparatus includes a motor-driven chain saw, cutoff machine and blower apparatus.

9. The internal combustion engine of claim 1, wherein said buffering means is disposed completely within said housing of said muffler without drawing air directly from the ambient.

10. The internal combustion engine of claim 1, wherein said housing has a partition wall partitioning said interior into a first space communicating with said inlet and a second space communicating with said discharge opening; and, said catalytic converter is mounted in said partition wall.

11. The internal combustion engine of claim 10, wherein said catalytic converter is configured as a cartridge.

12. The internal combustion engine of claim 10, said buffering means further comprising a buffering wall extending through said first space to partition said first space into a buffering space between said inlet and said buffering wall and into an ancillary space between said buffering wall and said catalytic converter; and, said buffering wall having a breakthrough formed therein to allow said gases to flow from said buffering space to said ancillary space and then flow mixed into said catalytic converter.

13. The internal combustion engine of claim 10, said buffering means further comprising a buffering wall extending through said first space to partition said first space into a buffering space between said inlet and said buffering wall and into an ancillary space between said buffering wall and said catalytic converter; and, said buffering wall having a plurality of strip-shaped breakthroughs formed therein and each of said breakthroughs having a bentover edge.

14. The internal combustion engine of claim 10, said muffler comprising an essentially closed covering surrounding at least said second space at a distance therefrom.

15. The internal combustion engine of claim 1, said buffering means for temporarily storing said oxygen-rich exhaust gas being arranged within said catalytic converter.

16. The internal combustion engine of claim 15, said buffering means comprising cerium oxide in said catalytic converter for temporarily storing the oxygen.

17. The internal combustion engine of claim 15, said buffering means comprising zirconium oxide in said catalytic converter for temporarily storing the oxygen.

18. The internal combustion engine of claim 15, said buffering means comprising aluminum oxide in said catalytic converter for temporarily storing the oxygen.

19. The internal combustion engine of claim 15, said buffering means comprising a mixture in said catalytic converter of cerium oxide, zirconium oxide and aluminum oxide for temporarily storing the oxygen.

20. The internal combustion engine of claim 15, wherein said buffering means comprises a cerium oxide and a zirconium oxide in stoichiometric and nonstoichiometric ratios.

21. The internal combustion engine of claim 15, wherein said buffering means includes at least one of the following oxides arranged within said catalytic converter: cerium oxide, zirconium oxide and aluminum oxide; and, said catalytic converter containing a migration inhibiting substance for the active centers thereof; and, said migration inhibiting substances including praseodymium or other lanthanides or actinides.

22. The internal combustion engine of claim 21, wherein said migration inhibiting substance is praseodymium.

23. The internal combustion engine of claim 21, wherein said migration inhibiting substances are lanthanides.

24. The internal combustion engine of claim 21, wherein said migration inhibiting substances are actinides.

25. An internal combustion engine including an engine in a portable handheld work apparatus, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an outlet for conducting oxygen-rich and oxygen-poor exhaust gases away from said combustion chamber;

a mixture-preparation unit for supplying an air/fuel mixture;

a first set of gas-supplying channels for supplying an air/fuel mixture to said combustion chamber prepared by said mixture preparation device;

a second set of gas-supplying channels for supplying oxygen-rich gas to said combustion chamber;

an exhaust-gas muffler having a housing and an inlet on said housing fluidly connected to said outlet to permit said oxygen-rich and said oxygen-poor exhaust gases to flow into said exhaust-gas muffler;

said housing having an interior and a partition wall for partitioning said interior into a first space communicating with said outlet and a second space;

a catalytic converter mounted in said housing;

means for temporarily storing said oxygen-rich exhaust gas to thereby evening out the oxygen component in the total exhaust-gas flow charging said catalytic converter;

said means for temporarily storing said oxygen-rich exhaust gas including a buffer space disposed essentially between said catalytic converter and said inlet; and, said means further including a wall extending in said buffer space and having a breakthrough formed therein.

26. An internal combustion engine including an engine in a portable handheld work apparatus, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an outlet for conducting oxygen-rich and oxygen-poor exhaust gases away from said combustion chamber;

a mixture-preparation unit for supplying an air/fuel mixture;

a first set of gas-supplying channels for supplying an air/fuel mixture to said combustion chamber prepared by said mixture preparation device;

a second set of gas-supplying channels for supplying oxygen-rich gas to said combustion chamber;

an exhaust-gas muffler having a housing and an inlet on said housing fluidly connected to said outlet to permit said oxygen-rich and said oxygen-poor exhaust gases to flow into said exhaust-gas muffler;

said housing having an interior and a partition wall for partitioning said interior into a first space communicating with said outlet and a second space;

a catalytic converter mounted in said housing;

means for temporarily storing said oxygen-rich exhaust gas to thereby even out the oxygen component in the total exhaust-gas flow charging said catalytic converter;

said means for temporarily storing said oxygen-rich exhaust gas including a buffer space disposed essentially between said catalytic converter and said inlet; and, said means further including a wall extending in said buffer space and said wall having a plurality of strip-shaped breakthroughs formed therein and each of said breakthroughs having a bentover edge.

27. An internal combustion engine including an engine in a portable handheld work apparatus, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an outlet for conducting oxygen-rich and oxygen-poor exhaust gases away from said combustion chamber;

a mixture-preparation unit for supplying an air/fuel mixture;

a first set of gas-supplying channels for supplying an air/fuel mixture to said combustion chamber prepared by said mixture preparation device;

a second set of gas-supplying channels for supplying oxygen-rich gas to said combustion chamber;

said first set of gas-supplying channels and said second set of gas-supplying channels opening into said combustion chamber so as to cause said oxygen-rich gases and said oxygen-poor exhaust gases to alternately flow through said outlet;

an exhaust-gas muffler having a housing and an inlet on said housing fluidly connected to said outlet to permit said oxygen-rich and said oxygen-poor gases to alternately flow into said exhaust-gas muffler;

said housing having an interior and a discharge opening communicating with said interior;

a catalytic converter mounted in said housing between said inlet and said discharge opening;

said housing has a partition wall partitioning said interior into a first space communicating with said inlet and a second space communicating with said discharge opening;

said catalytic converter is mounted in said partition wall;

a buffering wall extending through said first space to partition said first space into a buffering space between said inlet and said buffering wall and into an ancillary space between said buffering wall and said catalytic converter;

said buffering wall having a breakthrough formed therein to allow said gases to flow from said buffering space to said ancillary space and then flow mixed into said catalytic converter; and, buffering means for temporarily storing said oxygen-rich exhaust gas being arranged within said catalytic converter.

* * * * *